US005499931A

United States Patent [19]

Yang

[11] Patent Number: 5,499,931

[45] Date of Patent: Mar. 19, 1996

[54] ELECTRICAL-CONDUCTING STRUCTURE OF A LIGHTING FIXTURE

[76] Inventor: Jerry S. C. Yang, 8F-8, No. 20, Ta Lung Road, Taichung, Taiwan

[21] Appl. No.: 289,250

[22] Filed: Aug. 11, 1994

[51] Int. Cl.[6] ..... H01R 4/24

[52] U.S. Cl. ..... 439/431; 439/409

[58] Field of Search ..... 439/417–419, 439/395–407, 492, 498, 217, 218, 221, 431, 409–413

[56] References Cited

U.S. PATENT DOCUMENTS

| | | | |
|---|---|---|---|
| 2,758,280 | 8/1956 | More | 439/412 |
| 2,779,842 | 1/1957 | Walker | 439/425 |
| 2,795,768 | 6/1957 | Onckworth et al. | 439/425 |
| 2,848,643 | 8/1958 | Spataro | 439/411 |
| 2,981,921 | 4/1961 | Safford | 439/412 |
| 4,749,367 | 7/1988 | Fraser | 439/425 |

*Primary Examiner*—David L. Pirlot

*Attorney, Agent, or Firm*—Bacon & Thomas

[57] ABSTRACT

The invention relates to an improved lamp conducting structure, and more particularly to a lamp conducting structure design allowing for easy assembly with power wires of different thickness. A lower part of the lamp has a cylindrical body with an external thread and a cylindrical body bottom face is provided with radial inter-crossed slots. The slots are narrow and wide slots of different width and depth, and the cross junction of the two slots is provided with two diagonally installed metal clips with sharp needle heads facing downward. The user may select narrow or wide slots based on the power wire thickness, or even further incorporate a "U" type bar shaped cushion installed in the slot. The power wires are placed into the slots from the lamp cylindrical body bottom face and the external thread of the lamp bottom cylindrical structure is engaged with the internal thread of the lower frame top ring slot. The power wires are pressed by the lower frame top central cylinder to cause the conductive metal clip sharp needle to cut off the insulation layers of the power wires to contact with the metal part of the power wire. By this design, the lamp can be easily connected with power wires of different thickness.

3 Claims, 4 Drawing Sheets

ELECTRICAL-CONDUCTING STRUCTURE OF A LIGHTING FIXTURE

SUMMARY OF INVENTION

The invention relates to an improved lamp conducting structure, and more particularly to a lamp conducting structure design allowing for easy assembly with power wires of different thicknesses. A lower part of the lamp is a cylindrical body with an external thread and a cylindrical body bottom face is provided with radial inter-crossed slots. The slots can be narrow or wide slots of different width and depth. The cross junction of the two slots is provided with two diagonally installed metal clips with sharp needle heads facing downward. The user may select narrow or wide slots based on the power wire thickness or even further incorporate with a "U" type bar shaped cushion to be installed in the slot, wherein the power wires are placed into the slots from the lamp cylindrical body bottom face. The external thread of the lamp bottom cylindrical structure is engaged with the internal thread of the lower frame top ring slot, thereby the power wires are pressed by the lower frame top central cylinder to let the conductive metal clip sharp needle cut off the insulation layers of the power wires to contact with the metal part of the power wire. By this design, the lamp can be easily connected with power wires of different thickness. The design is simple in structure and is very useful.

DETAILED DESCRIPTION OF THE PREFERRED EMBODIMENT

Figure 1:
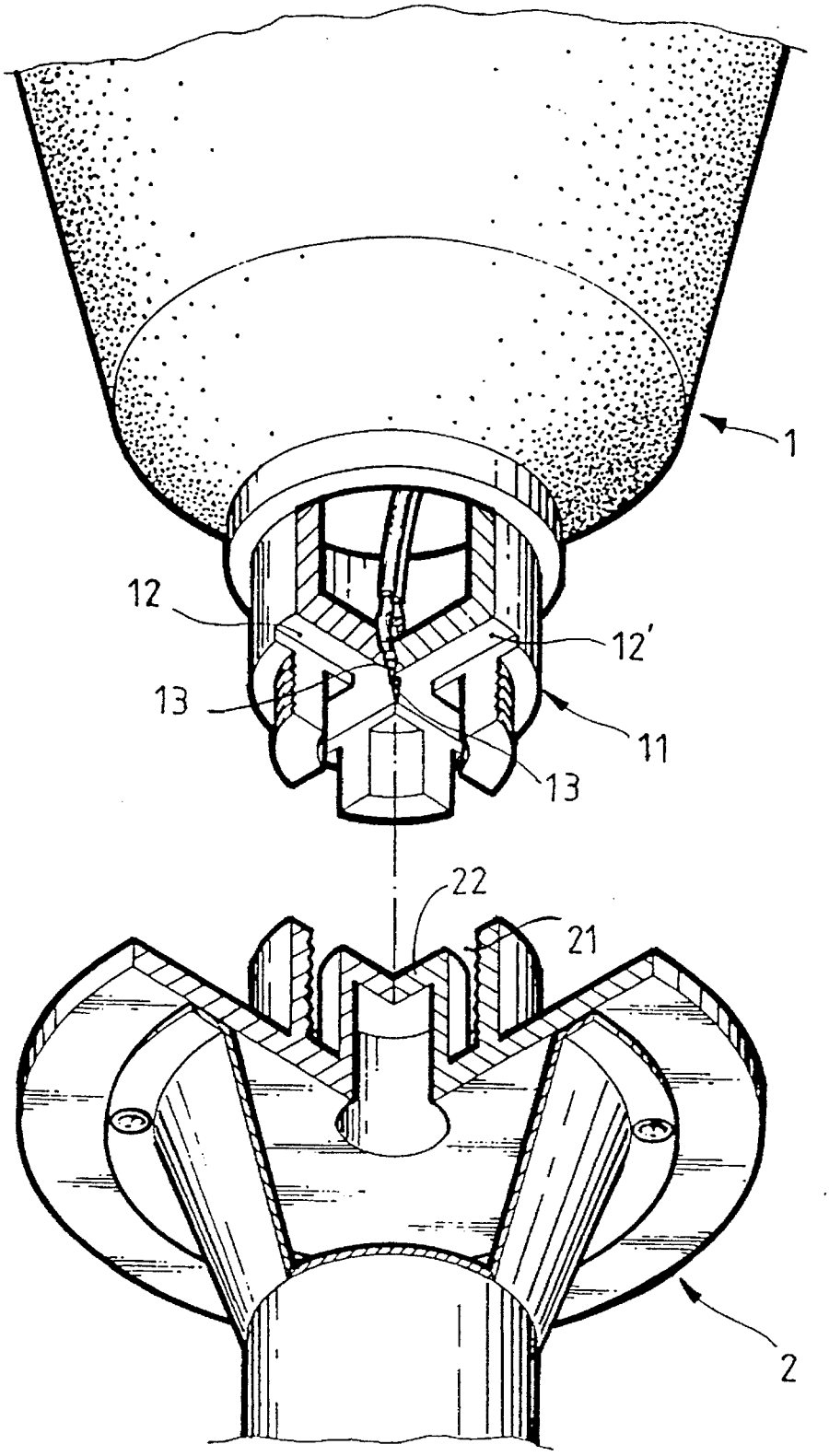
FIG. 1 is an exploded perspective view of the invention.

The invention relates to an improved lamp conducting structure, and more particularly to a lamp conducting structure design allowing for very easy connection with power wires of different thickness. Thereby, the lamp can be quickly and effectively connected with power wires of different thickness to make the structure simple and more useful.

Though there are numerous types of lamp structure designs, in most of the conventional lamp structure designs it is necessary to remove the outer insulation layer of the power wire and then to wind up or weld the metal wire within the power wire on the power junction location of the lamp conducting structure and further to wrap up the junction area with insulation tape, thereby to complete the safe power circuit. Nonetheless, the installation process of such power connection method is more complicated, and more particularly for the case when one power wire is used to connect with several lamps, it is not only laborious and time-consuming, but also due to the loss of material from having to cut off the outer insulation layer of the power wire and to wind up or weld on the junction, the length of power wire is thus shortened. Therefore, some manufacturers have developed another lamp conducting structure, in which is installed sharp needle head type conductive metal clips within the lamp to cut off the insulation layer of the power wire and to conduct with the metal wire of the power wire. Therefore, it is well accepted due to the quick connection with the power source, and is particularly outstanding in the application on the parallel combination of the outdoor yard lamps or road lamps. However, though the said usual lamp structure design satisfies the requirement of quick connection with the power source, it is not widely applicable to the market available power wires of different thickness, and is greatly limited to only connect with the single specification power wires. In addition, the usual structure design does not provide a design to connect between the power wires for extension and is therefore difficult to meet practical requirements at the present time. Regarding this, the invention ingeniously makes the lamp lower part form a cylindrical body, wherein the said cylindrical body bottom face is provided with radial inter-crossed slots, whereof the said slots can be narrow or wide slots of different width and depth, and whereat the cross junction of the two slots is provided with two diagonally installed metal clips with sharp needle heads facing downward. The user may select narrow or wide slots based on the power wire thickness and the power wires are placed into the said slots from the slot cylindrical body bottom face. The external thread of the slot bottom cylindrical structure is engaged with the internal thread of the lower frame top ring slot, thereby the power wires are pressed by the lower frame top central cylinder to force the conductive metal clip sharp needle to cut off the insulation layers of the power wires to contact with the metal part of the power wire. Therefore, the slot can be easily connected with power wires of different thickness. The lamp conducting can be further designed to a structure capable of connecting another power wire by utilizing two connected conductive metal clips to respectively cut off the insulation layers of the two power wires of different thickness within the two slots, to thereby connect the two power wires for extending the length of the power wire.

The main purpose of the invention is to provide an improved slot conducting structure, wherein the cylindrical body bottom face is provided with radial narrow and wide inter-crossed slots of different width and depth to accommodate power wires of different thickness specifications. Two metal clips with sharp needle heads are diagonally installed at the cross junction of the two slots and can easily cut off the insulation layer of the power wire for conduction.

The secondary purpose of the invention is to provide an improved slot conducting structure for utilizing the narrow or wide slots of different width and depth to accommodate the power wires of the different thickness in which "U" type bar shaped cushions can be provided within the said slots to hold the power wires more firmly fixed in the slot.

Another purpose of the invention is that the two connected conductive metal clips are respectively installed in two slots, then the two power wires of different thickness and sources are placed into the slots, the conductive metal clips cut off the insulation layer of the power wire to allow for mutual connection between the two power wires, to effectively extend the length of the power wire or to connect the two power wires of different thickness for further complying with the application requirements.

Figure 2:
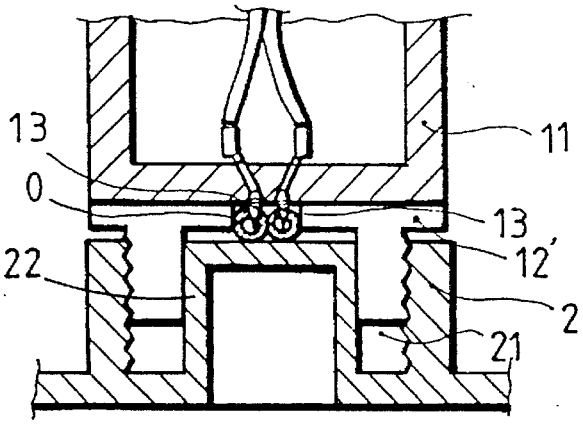
FIG. 2 is a cross-sectional view of the invention.
Figure 3:
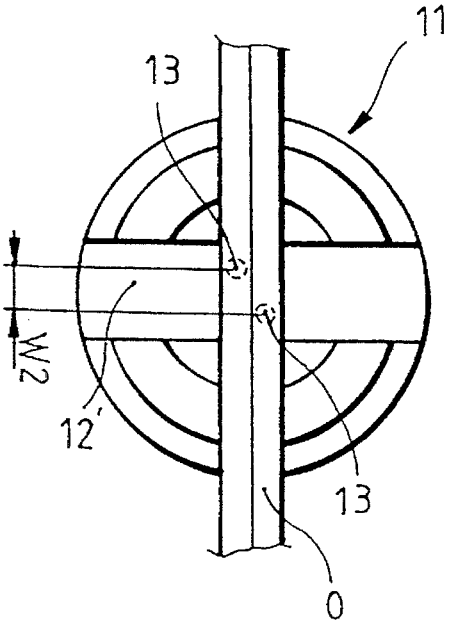
FIG. 3 is a schematic diagram of the invention showing its use with a thin power wire.
Figure 4:
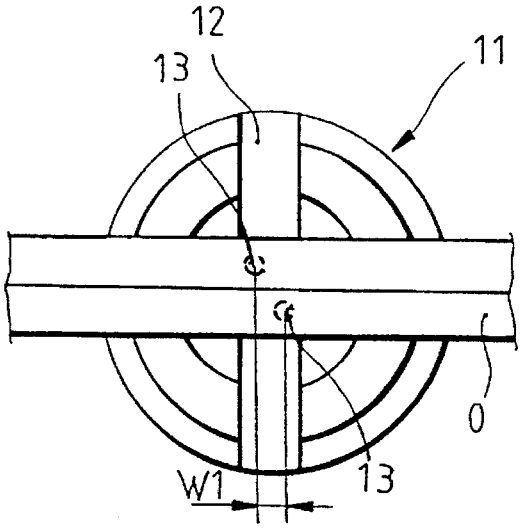
FIG. 4 is a schematic diagram of the invention showing its use with a thick power wire.

The structure characteristics and other features as well as the purposes of the invention are described in detail by the enclosed figures of embodying examples as follows:

As shown in FIGS. 1 and 2, the slot conducting structure design of the invention is an improved slot conducting structure, wherein the power wire 0 can be connected with another power wire of different thickness specifications 0 without cutting off their insulation materials beforehand. The lower part of the main body of the lamp 1 is a cylindrical body 11 with an external thread, and the lower frame 2 is also provided with a cylindrical body wherein a ring slot 21 with an internal thread is installed on the top face of the said cylinder body to engage with the external thread of the lower end of the cylindrical body 11 of lamp 1, and is characterized in the following:

The bottom face of the cylindrical body 11 at the lower end of the lamp 1 is provided with two inter-crossed slots 12, 12' (as shown in FIGS. 3 and 4), wherein the two slots 12, 12' are either the narrow slot 12 or wide slot 12' of different width and dept. The cross junction of the two slots is provided with two diagonally installed metal clips 13 with sharp needle heads facing downward. Due to the diagonal installation of the said sharp needle head metal clips 13, the perpendicular width W1 between the thin slot 12 and the thin power wire is smaller than the perpendicular width W2 between the thick slot 12' and the thick power wire, i.e. width W1<width W2. Therefore, the user can select the narrow slot 12 or the wide slot 12' based on the thickness of power wire 0, thereby to let the power wire 0 be placed into the slots 12, 12' through the bottom face of cylindrical body 11 of lamp 1. The external thread of the bottom end of cylindrical body 11 of the lamp 1 is engaged with internal thread of the top end ring slot 21 of the lower frame 2. The power wire 0 is pressed by the top end central cylinder 22 of the lower frame 2 to cause the sharp needle head of the conducting metal clips 13 to cut off the insulation layer of the power wire 0- and to contact with the metal wire of the power wire. Therefore this design provides that the lamp 1 can be easily connected with power wires of different thickness and is a simple and useful structure design.

Figure 5:
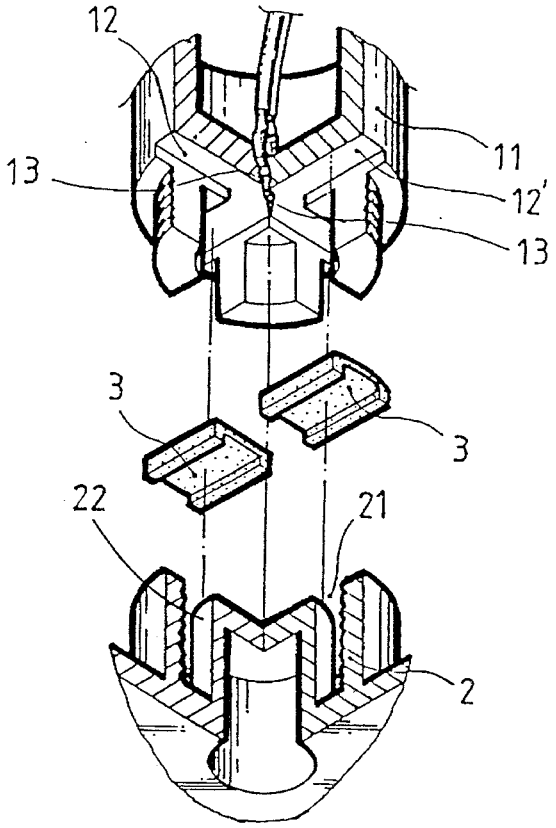
FIG. 5 is an exploded perspective view of the invention illustrating the additional installation of "U" type bar shaped cushions.
Figure 6:
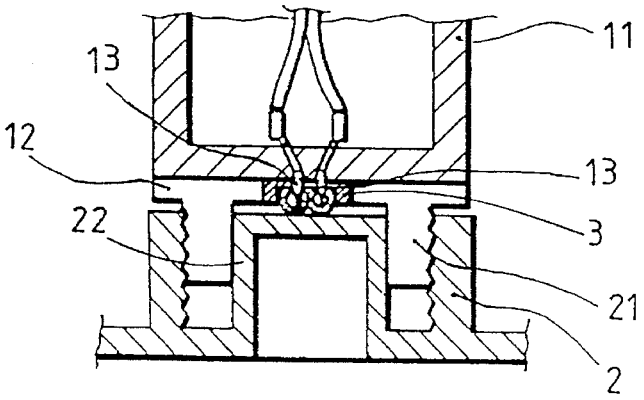
FIG. 6 is a cross-sectional schematic view of an embodying example of the invention illustrating the additional installation of the "U" type bar shaped cushions.

Further, though the two inter-crossed narrow slot 12 or wide slot 12' at the bottom face of the lower cylindrical body 11 of the lamp 1 are capable of accommodating power wires of two different thickness specifications, as the power wires the market have more thickness specifications and for wider application as well as for better holding of the power wire 0, the slots 12, 12' can be further placed with a "U" type bar shaped cushion 3 of different thickness for the power wire 0 to be more firmly fixed within the slots 12, 12' and to be more useful (as shown in FIGS. 5 and 6).

Figure 7:
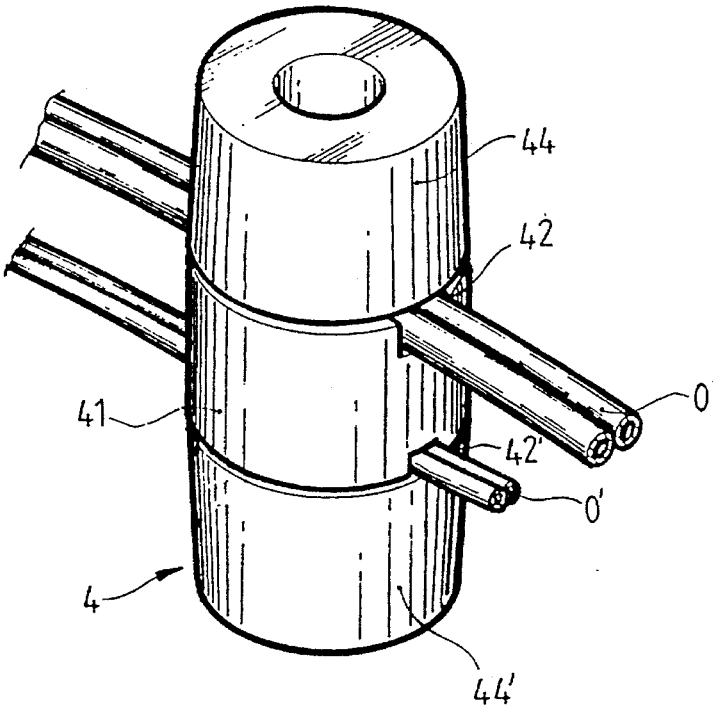
FIG. 7 is a perspective view of the invention illustrating a junction mounting for two power wires.
Figure 8:
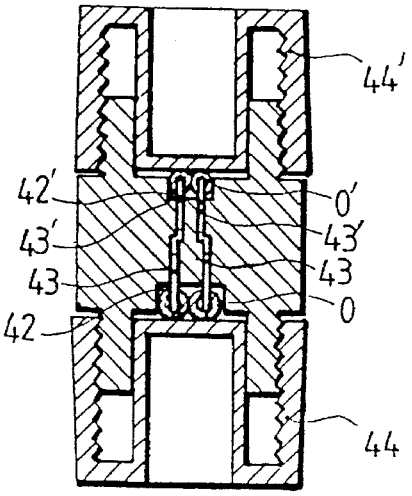
FIG. 8 is a cross-sectional view of the invention illustrating the junction mounting for the two power wires of FIG. 7.

In addition, as shown in FIGS. 7 and 8, the invention is further designed to be a connected mounting 4 to effectively connect the power wires for extension or to connect the power wires 0, 0' of different thickness. The mounting has two ends of a cylindrical body 41 respectively provided with external threads, and the two end faces are respectively provided with slots 42, 42' designed to a narrow slot 42 or a wide slot 42' of different width and depth as required, wherein the two slots 42, 42' are respectively installed with two conductive metal clips 43, 43'. The clips 43, 43' are mutually connected, therefore the two power wires of different thickness and sources 0, 0' are placed into the two slots 42, 42' and let the two cover bodies 44, 44' be engaged through the internal threads of their top end ring slots, thereby to cause the power wires 0, 0' to be pressed by the top end central cylinder of the cover bodies 44, 44 ', and let the conductive metal clips cut off the insulation layer of the power wire to allow for mutual conduction between the two power wires 0, 0', to effectively connect the two power wires 0, 0' to achieve the requirements of usefulness and convenience.

As summarized above, it is obvious that the invention is more innovative and original than the usual lamp conducting structure and the usual power wire connection methods, while its effectiveness completely meets the expected design purposes, therefore it is a very useful and progressive design.

I claim:

1. An improved lamp conducting structure, wherein a rear end of a lower cylindrical body of the lamp is provided with external thread, and a ring slot with internal thread is installed at a top end face of a lower frame cylindrical body thereby to engage with the external thread of the rear end of the lamp cylindrical body and is characterized in the following:

a bottom face of the lower cylindrical body of the lamp is provided with two inter-crossed slots, wherein the two slots have a different width and depth, whereat the cross junction of the two slots is provided with two diagonally installed metal clips with sharp needle heads, and due to the diagonal installation of the said sharp needle head metal clips, a perpendicular width between the metal slips in the two slots and the power wires can be one or more than one width;

by utilizing the above said structure design, a user can select a narrow slot or a wide slot based on the thickness of a power wire, thereby to let the power wire be placed into the slots through the bottom face of cylindrical body of the lamp, wherein the external thread of the bottom end cylindrical body of the lamp is engaged with the internal thread of the top end ring slot of the lower frame, thereby a power wire is pressed by the top end central cylinder of the lower frame to cause the sharp needle head of the conducting metal clips to cut off the insulation layer of the power wire and to contact with the metal wire of the power wire.

2. The improved conducting structure of claim 1, wherein the slots on the bottom face of the lower end cylindrical body further comprise a "U" type bar shaped cushion.

3. The improved lamp conducting structure of claim 1 wherein the two power wires can be connected through a connection mounting, said mounting is a cylindrical body with two ends respectively provided with external threads, and two end faces are respectively provided with a slot, wherein the two slots are of different width and depth, and the said two slots are further respectively installed with two conducting metal clips and said metal clips are mutually connected, therefore when two power wires of different thickness or sources are respectively placed within the slots and two end cover bodies are engaged through the internal threads of their top end ring slots, the two power wires are then mutually connected.

* * * * *